United States Patent [19]

Camilleri

[11] 4,171,810

[45] Oct. 23, 1979

[54] REAR FILLER PAD ASSEMBLY

[76] Inventor: Thomas M. Camilleri, 277 Ave. West, Brooklyn, N.Y. 11223

[21] Appl. No.: 860,579

[22] Filed: Dec. 14, 1977

Related U.S. Application Data

[63] Continuation-in-part of Ser. No. 781,572, Mar. 28, 1977, abandoned.

[51] Int. Cl.[2] ..... A63D 5/02
[52] U.S. Cl. ..... 273/49
[58] Field of Search ..... 273/43 R, 43 A, 49; 16/86 R, 86 A

[56] References Cited

U.S. PATENT DOCUMENTS

| | | | |
|---|---|---|---|
| 264,438 | 9/1882 | Burrill | 16/86 A UX |
| 1,858,541 | 5/1932 | Duffy | 16/86 A UX |
| 3,297,322 | 1/1967 | Ernst et al. | 273/49 X |

*Primary Examiner*—Anton O. Oechsle
*Attorney, Agent, or Firm*—Donald J. Perrella

[57] ABSTRACT

A rear filler pad assembly for an automatic pinspotter bowling machine is formed of two ribbed attaching segments and a grommet receiving segment having elongated serrated slots. Each slot has a wide opening at one end thereof into which a grommet is inserted. The grommet is then moved along the slot until it is in registration with the associated ball kicker shaft. The narrow portion of each slot holds the grommet firmly in place.

13 Claims, 3 Drawing Figures

10
11
12
13
14
15
16
17
18
19
20
21
22
23
24
25
26
27
28
29

REAR FILLER PAD ASSEMBLY

RELATED APPLICATION

This application is a continuation-in-part of copending application Ser. No. 781,572 filed Mar. 28, 1977, abandoned.

BACKGROUND OF THE INVENTION

In one type of automatic pinspotting bowling machine one component of the ball exit system which leads a bowling ball to the ball return track and the ball lift belt is the rear filler pad assembly consisting of left and right side attaching members and a center portion joined to the side attaching members. Passing upwardly behind the rear filler pad assembly are two shafts. At the upper end of each shaft is a ball kicker which moves the bowling ball to the ball return track. Tensioning means press the ball kicker shafts against the rear filler pad assembly. The rear filler pad assembly has means for attaching two grommet-like bumpers each of which contacts one of the ball kicker shafts and prevents the shaft from coming into direct contact with the rear filler pad assembly. Because the rear filler pad assembly must be positioned exactly at the center of the ball return track and has to be affixed to the sides of two adjacent pinspotting machines which are not always the same distance from the center of the ball return track the bumper holes in the filler plate are not always in registration with the ball kicker shafts. As a result the bumpers do not always contact the shafts and the shafts ride against the filler plate thereby abrading, eroding and cracking the filler plate.

OBJECTS OF THE INVENTION

It is an object of the present invention to provide an improved rear filler pad assembly which always permits the bumpers to engage the ball kicker shafts regardless of the position of the shafts. Another object is to provide a rear filler pad assembly having means for rapidly adjusting the position of the bumpers. A further object is to provide a rear filler pad assembly having greater strength and rigidity. These and other objects of the present invention will be apparent from the following description.

SUMMARY OF THE INVENTION

An improved rear filler pad is formed of two ribbed attaching segments and a center segment having elongated serrated slots for exact registration of bumpers with the ball kicker shafts, and for holding the bumpers firmly in place.

BRIEF DESCRIPTION OF THE DRAWINGS

FIG. 3 is a front elevation.

DETAILED DESCRIPTION

Figures 1, 2, 4:
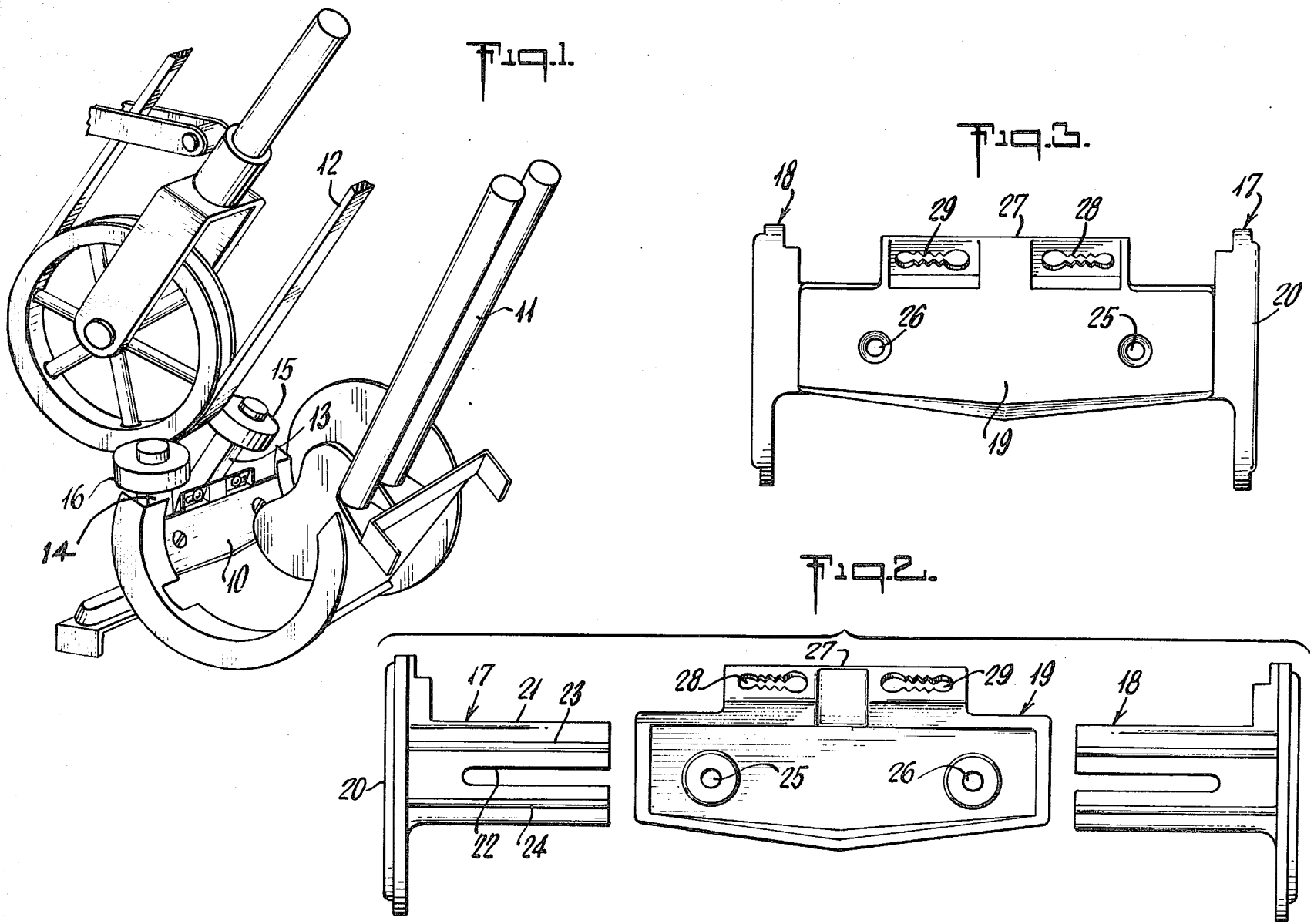
FIG. 1 is a perspective of the rear filler pad assembly, ball lift belt and ball return track.
FIG. 2 is a exploded rear elevation of the rear filler pad assembly.

As shown in FIG. 1, the rear filler pad assembly forms part of the assembly which delivers a bowling ball to the ball return track 11 where the ball is engaged by ball lift belt 12. Located behind the rear filler pad assembly are the shaft housings 13 and 14 of the ball kickers 15 and 16, respectively.

As shown in FIGS. 2 and 3, the rear filler pad assembly consists of side segments 17 and 18, and member 19. Side segments 17 and 18 consist of an arcuate section 20 having an elongated section 21 extending from and substantially perpendicularly to its inner curved surface. Section 21 is provided with a slit 22 which divides section 21 into an upper and a lower portion. The portions of section 21 are provided with reinforcing ribs 23 and 24, respectively. Side segment 18 is a mirror image of segment 17.

Member 19 consists of a substantially rectangular plate having two holes 25 and 26 for bolting member 19 to side segments 17 and 18, respectively, through slit 22. The top center of member 19 is provided with rectangular section 27 having elongated serrated slots 28 and 29. Each slot has a wide opening nearest the center of member 19. The wide opening permits insertion of bumper means or a grommet which is then moved laterally toward the side of member 19 whereby it enters into the narrow portion of the slot and is moved laterally until in registration with the adjacent ball kicker shaft housing. The narrow portion of the slot holds the bumper means or grommet firmly in place. The bumper means or grommet now is fixed in position and prevents the ball kicker shaft housing from damaging the filler plate.

Members 17, 18 and 19 may be formed of metal, e.g., aluminum, by any desired means, e.g., casting or machining.

What is claimed is:

1. In an automatic pinspotter bowling machine having a rear filler pad comprising a member adapted to receive bumper means and a ball kicker shaft housing normally biased against the rear filler pad, the improvement comprising means for readily installing and positioning bumper means to prevent the ball kicker shaft housing from contacting the member, the means comprising an elongated slot having a wide opening for inserting the bumper means and a plurality of serrations to lock the bumper means in a desired position in the slot.

2. In an automatic pinspotter according to claim 1 the improvement wherein the wide opening is closer to the center of the central segment than the plurality of serrations.

3. In an automatic pinspotter according to claim 2 the improvement wherein the member has at least one side segment for joining the member to support means.

4. In an automatic pinspotter according to claim 1 the improvement wherein the member has a second elongated slot adapted to receive bumper means to prevent a second ball kicker shaft housing normally biased against the rear filler pad from contacting the member, the second slot having a wide opening for inserting the bumper means and a plurality of serrations to lock a bumper means in a desired position in the slot.

5. In an automatic pinspotter according to claim 4 the improvement wherein the member has at least one side segment for joining the member to support means.

6. In an automatic pinspotter according to claim 1 the improvement wherein the member has at least one side segment for joining the member to support means.

7. In an automatic pinspotter according to claim 6 the improvement wherein the side segment comprises an arcuate member having an elongated section extending substantially perpendicularly from about the middle of the arcuate member, the elongated member being provided with a slot dividing the elongated member into an upper and lower portion, at least one portion having a reinforcing rib.

8. In an automatic pinspotter according to claim 6 the improvement wherein the side segment comprises an arcuate member having an elongated section extending substantially perpendicularly from about the middle of the arcuate member, the elongated member being provided with a slot dividing the elongated member into an upper and lower portion, each portion having a reinforcing rib.

9. In an automatic pinspotter according to claim 6 the improvement wherein the member has two side segments for joining the member to support means.

10. In an automatic pinspotter according to claim 9 the improvement wherein at least one side segment comprises an arcuate member having an elongated section extending substantially perpendicularly from about the middle of the arcuate member, the elongated member being provided with a slot dividing the elongated member into an upper and lower portion.

11. In an automatic pinspotter according to claim 10 the improvement wherein each portion has a reinforcing rib.

12. In an automatic pinspotter according to claim 9 the improvement wherein each side segment comprises an arcuate member having an elongated section extending substantially perpendicularly from about the middle of the arcuate member, the elongated member being provided with a slot dividing the elongated member into an upper and lower portion.

13. In an automatic pinspotter according to claim 12 the improvement wherein each portion has a reinforcing rib.

* * * * *